US010883501B2

(12) United States Patent
Moon et al.

(10) Patent No.: US 10,883,501 B2
(45) Date of Patent: Jan. 5, 2021

(54) TWO-STAGE ROTARY COMPRESSOR

(71) Applicant: LG Electronics Inc., Seoul (KR)

(72) Inventors: Seokhwan Moon, Seoul (KR); Kiyoul Noh, Seoul (KR); Jinung Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 275 days.

(21) Appl. No.: 16/019,891

(22) Filed: Jun. 27, 2018

(65) Prior Publication Data

US 2018/0372102 A1 Dec. 27, 2018

(30) Foreign Application Priority Data

Jun. 27, 2017 (KR) ..... 10-2017-0081474

(51) Int. Cl.
*F03C 2/00* (2006.01)
*F03C 4/00* (2006.01)
(Continued)

(52) U.S. Cl.
CPC ..... *F04C 18/3441* (2013.01); *F01C 21/0863* (2013.01); *F01C 21/108* (2013.01);
(Continued)

(58) Field of Classification Search
CPC .... F04C 18/344; F04C 18/3441; F04C 23/00; F04C 23/001; F04C 23/008;
(Continued)

(56) References Cited

U.S. PATENT DOCUMENTS 129,953 A * 7/1872 Hawley et al. ..... F01C 21/0863 418/238
1,457,696 A * 6/1923 Ford ..... F01C 21/106 418/236
(Continued)

FOREIGN PATENT DOCUMENTS

JP 2010-183086 8/2010
KR 10-2013-0094651 A 8/2013
(Continued)

OTHER PUBLICATIONS

International Search Report, dated Oct. 23, 2018, issued in PCT/KR2018/007309 (9 pages).

*Primary Examiner* — Theresa Trieu
(74) *Attorney, Agent, or Firm* — Finnegan, Henderson, Farabow, Garrett & Dunner LLP

(57) ABSTRACT

The present disclosure relates to a two-stage rotary compressor in which refrigerant inhaled into a compression space of a cylinder is compressed sequentially in two axially connected compression chambers and then is discharged. A rotary compressor according to an embodiment of the present disclosure includes a first compression unit and a second compression unit arranged on and along a single rotation shaft. Middle-pressure refrigerant discharged from the first compression unit flows into the second compression unit. A maximum gas force of the first compression unit and a maximum gas force of the second compression unit counteract with each other, thereby reducing a reaction force acting on a rotation shaft. According to the present disclosure, a single rotary compressor is configured to separately achieve the stroke volume increase and the compression period increase.

12 Claims, 9 Drawing Sheets

(51) Int. Cl.

| | |
|---|---|
| ***F04C 2/00*** | (2006.01) |
| ***F04C 18/00*** | (2006.01) |
| ***F04C 18/344*** | (2006.01) |
| ***F04C 23/00*** | (2006.01) |
| ***F25B 31/02*** | (2006.01) |
| ***F25B 1/10*** | (2006.01) |
| ***F01C 21/08*** | (2006.01) |
| ***F01C 21/10*** | (2006.01) |
| *F25B 1/04* | (2006.01) |

(52) U.S. Cl.
CPC ..... *F04C 23/00* (2013.01); *F04C 23/001* (2013.01); *F04C 23/008* (2013.01); *F25B 1/10* (2013.01); *F25B 31/026* (2013.01); *F04C 2240/20* (2013.01); *F04C 2240/50* (2013.01); *F25B 1/04* (2013.01); *F25B 2400/074* (2013.01)

(58) Field of Classification Search
CPC ..... F04C 2240/074; F04C 2240/20; F04C 2240/50; F01C 21/0863; F01C 21/0809; F01C 21/108; F25B 1/04; F25B 1/10; F25B 31/026; F25B 2400/074
USPC ..... 418/5, 11, 13, 60, 63, 236–238, 259
See application file for complete search history.

(56) References Cited

U.S. PATENT DOCUMENTS

| | | | | |
|---|---|---|---|---|
| 7,942,648 | B2 * | 5/2011 | Sakuda | F01C 21/0863 418/238 |
| 2013/0084202 | A1 * | 4/2013 | Takahashi | F01C 21/106 418/236 |
| 2015/0147216 | A1 * | 5/2015 | Shimaguchi | F01C 21/106 418/236 |
| 2017/0030353 | A1 | 2/2017 | Nagano et al. | |

FOREIGN PATENT DOCUMENTS

| | | | |
|---|---|---|---|
| KR | 10-2014-0011077 | A | 1/2014 |
| KR | 10-2016-0038840 | A | 4/2016 |

* cited by examiner

PRIOR ART

TWO-STAGE ROTARY COMPRESSOR

CROSS-REFERENCE TO RELATED APPLICATIONS

This application claims the benefit of priority of Korean Patent Application No. 10-2017-0081474, filed on Jun. 27, 2017, in the Korean Intellectual Property Office, the disclosure of which is hereby incorporated by reference in its entirety.

BACKGROUND

1. Technical Field

The present disclosure relates to a 2-stage (two-stage) rotary compressor in which refrigerant inhaled into a compression space of a cylinder is compressed sequentially in two compression chambers axially connected and then is discharged.

2. Description of the Related Art

A compressor is applied to a vapor compression-based refrigeration cycle such as refrigerators and air conditioners. The compressors may be classified into indirect suction type or direct suction type compressors based on a way in which refrigerant is sucked into a compression chamber.

In the indirect suction type compressor, refrigerant circulating in the refrigeration cycle is introduced into an inner space of the compressor case and then sucked into a compression chamber.

In the direct suction type compressor, the refrigerant is sucked directly into the compression chamber. The indirect suction type compressor may be referred to as a low pressure compressor. The direct suction type compressor may be referred to as a high pressure compressor.

In the low-pressure compressor, the refrigerant is first introduced into the interior space of the compressor case, so that refrigerant or oil at a liquid state is filtered in the interior space of the compressor case. This eliminates a need for a separate accumulator.

On the other hand, in the high-pressure compressor, an accumulator is usually provided on an upstream side (suction side) of the compression chamber in order to prevent the liquid refrigerant or oil from entering the compression chamber.

Further, the compressor may be classified as a rotation type compressor or a reciprocating compressor based on a method of compressing the refrigerant.

In the rotation type compressor, a volume of the compression space is varied as a rolling piston rotates or revolves in the cylinder. In the reciprocating compressor, the piston reciprocates in the cylinder, thereby varying the volume of the compression space.

The rotation type compressor includes a rotary compressor for compressing the refrigerant using a rotational force of driving means.

In recent years, studies have been focused on improving an efficiency of the rotary compressor while gradually miniaturizing the rotary compressor. Furthermore, research for obtaining a larger cooling/heating capacity by increasing a variable range of an operation speed of the miniaturized rotary compressor has been continuously carried out.

The rotary compressor includes driving means and a compression unit inside a case. The driving means and the compression unit compress and discharge refrigerant as inhaled thereto. The driving means sequentially includes a rotor and a stator arranged around a rotation shaft. When power is applied to the stator, the rotor rotates inside the stator to rotate the rotation shaft.

The compression unit includes a cylinder having a compression space defined therein, a rolling piston (hereinafter abbreviated as a roller) coupled to the rotation shaft, and a vane for dividing the compression space into a suction chamber and a compression chamber.

Inside the cylinder, there is provided a roller which rotates about the rotation shaft and defines a plurality of compression spaces together with the vane. The roller rotates in a concentric manner with the rotation shaft.

A plurality of vane slots is radially arranged in an outer circumferential face portion of the roller. Each vane is slidably withdrawn out of each vane slot.

Each vane is withdrawn outwardly from each vane slot and brought into close contact with an inner circumferential surface of the cylinder via a back pressure of the oil generated at a rear end and a centrifugal force from a rotation of the roller. As a result, the refrigerant contained in the internal space of the cylinder may be compressed.

That is, the refrigerant introduced into the suction chamber is compressed to a constant pressure by the vane moving along the inner circumferential surface of the cylinder. The compressed refrigerant is then discharged to a rear end of the refrigeration cycle via a discharge pipe.

In such a rotary compressor, a volume diagram indicating a change in volume may vary depending on a shape of the cylinder. A sum of a suction period and a compression period varies depending on the number of vanes.

Increasing the number of vanes decreases the suction and compression periods, but increases the volume of the stroke. Conversely, decreasing the number of vanes increases the suction and compression periods, but reduces the stroke volume.

Further, in a vicinity of a discharge region, an axial maximum gas force is located. The number of times the maximum gas force is generated corresponds to the number of vanes per a single revolution.

Therefore, when the number of vanes is increased, the stroke volume is increased but the suction period and compression period are decreased, resulting in over-compression. Further, a mechanical loss (friction loss) is increased due to the increase in the number of vanes.

Further, in the rotary compressor, since a position of the axial maximum gas force is unchanged, and the number of times the axial maximum gas force is generated corresponds to the number of vanes per a single revolution, it is difficult to secure durability of the rotary compressor.

SUMMARY

A purpose of the present disclosure is to provide a 2-stage (two-stage) compressor including two compression units, wherein middle-pressure refrigerant discharged from a first compression unit flows into a second compression unit.

Another purpose of the present disclosure is to provide a structure capable of ensuring reliability of the rotary compressor by cancelling force acting on a rotation shaft of the rotary compressor such that net reaction force applied to a journal of the compressor rotation shaft is reduced.

Still another purpose of the present disclosure is to provide a rotary compressor structure that may allow increasing a compression period of the second compression unit and securing a suction flow amount of the first compression unit.

A rotary compressor according to an embodiment of the present disclosure includes a first compression unit and a second compression unit arranged on and along a single rotation shaft. The first compression unit and second compression unit may be configured such that middle-pressure refrigerant discharged from the first compression unit flows into the second compression unit.

Further, a rotary compressor according to an embodiment of the present disclosure may be configured such that a maximum gas force of the first compression unit and a maximum gas force of the second compression unit may counteract each other, thereby to reduce net reaction force applied to a journal of the rotation shaft.

Moreover, a rotary compressor according to an embodiment of the present disclosure may be configured such that a number of vanes of the first compression unit is larger than a number of vanes of the second compression unit. Thus, the first compression unit secures a suction flow rate, while the second compression unit has an increased compression period.

The rotary compressor according to the present disclosure the two-stages compression unit configuration in which the first compression unit secures a suction flow rate, while the second compression unit has an increased compression period. This may improve performance of the rotary compressor.

According to the present disclosure, the single rotary compressor may be configured to separately achieve the stroke volume increase and the compression period increase.

Further, the rotary compressor according to the present disclosure allows the maximum gas force of the first compression unit and the maximum gas force of the second compression unit to counteract with each other, thereby reducing the repulsive force acting on the rotation shaft. This leads to improving the reliability of the compressor product.

DETAILED DESCRIPTION

Figure 1:
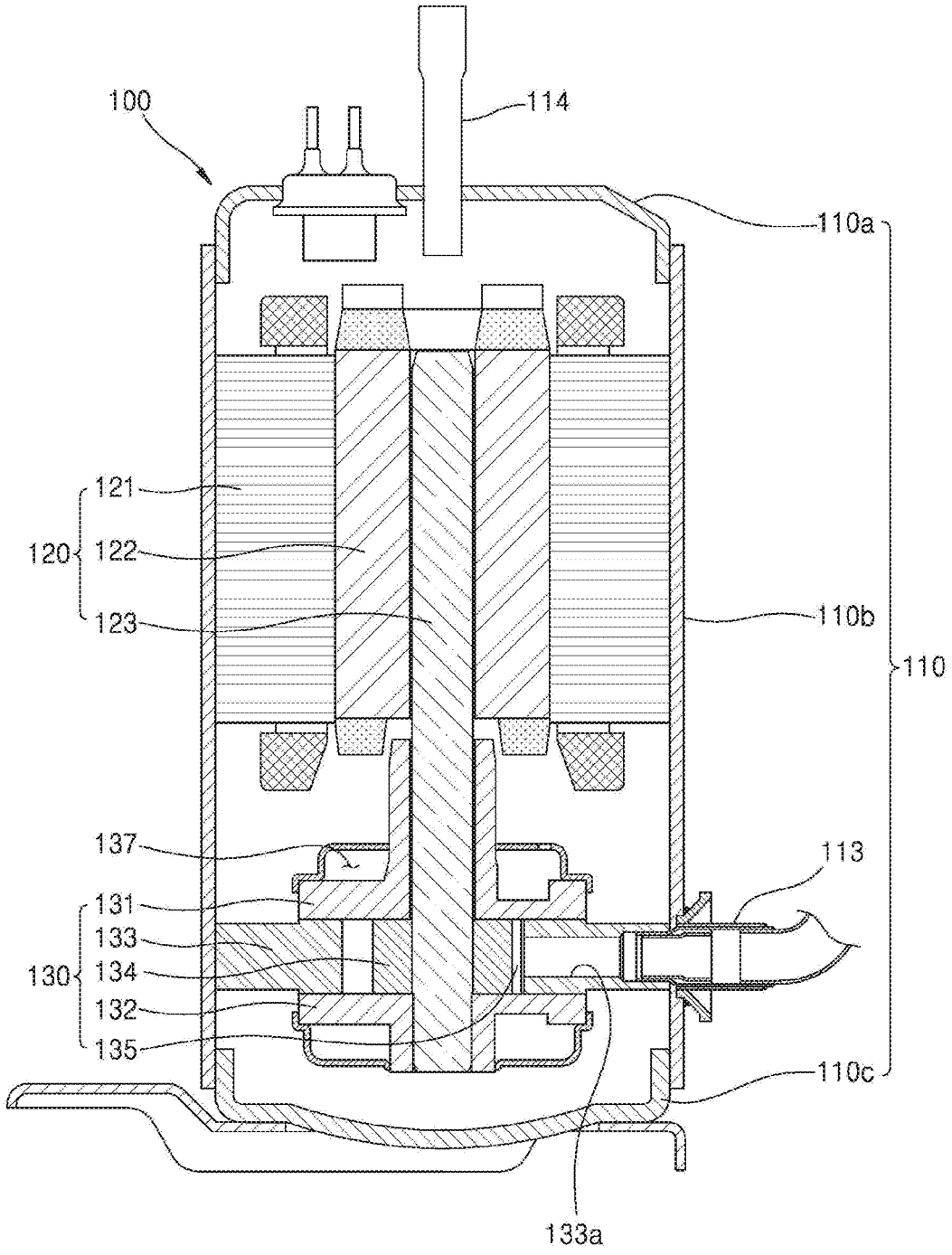
FIG. 1 is a sectional view showing an internal structure of a conventional rotary compressor.

The above objects, features and advantages will become apparent from the detailed description with reference to the accompanying drawings. Embodiments are described in sufficient detail to enable those skilled in the art in the art to easily practice the technical idea of the present disclosure. Detailed descriptions of well known functions or configurations may be omitted in order not to unnecessarily obscure the gist of the present disclosure. Hereinafter, embodiments of the present disclosure will be described in detail with reference to the accompanying drawings. Throughout the drawings, like reference numerals refer to like elements.

Hereinafter, a structure of a rotary compressor according to an embodiment of the present disclosure will be described in detail with reference to the accompanying drawings.

First, a structure and operation principle of a conventional rotary compressor will be described.

FIG. 1 is a cross-sectional view showing an internal structure of a rotary compressor.

A rotary compressor 100 includes a casing 110, driving means 120, and a compression unit 130.

The casing 110 forms an appearance of the compressor. The casing 110 may have a cylindrical shape extending along one direction. The casing may be formed along an extending direction of a rotation shaft 123.

Inside the casing 110, a cylinder 133 is disposed. The cylinder 133 has compression spaces V1 and V2 defined therein where suctioned refrigerant thereto is compressed therein and then discharged to the outside.

The casing 110 includes an upper shell 110*a*, a middle shell 110*b*, and a lower shell 110*c*. On an inner face of the middle shell 110*b*, the driving means 120 and compression unit 130 may be fixedly installed. The upper and lower shells 110*a* and 110*c* are located above and below the middle shell 110*b*, respectively. The upper shell 110*a* and the lower shell 110*c* prevent components located in the casing from being exposed to the outside.

The compression unit 130 compresses and discharges the refrigerant. The compression unit 130 includes a roller 134, a vane 135, a cylinder 133, a main bearing 131, and an auxiliary bearing 132.

The driving means 120 may be disposed above the compression unit 130. The driving means 120 serves to provide power for compressing the refrigerant. The driving means 120 includes a stator 121, a rotor 122, and a rotation shaft 123.

The stator 121 may be fixedly installed inside the casing 110. The stator 121 may be mounted on the inner circumferential face of the cylindrical casing 110 via a shrink fit. The stator 121 may be fixed to the inner circumferential face of the middle shell 110*b* of the cylindrical casing 110.

The rotor 122 may be rotatably disposed inside the stator 121. The rotor 122 is rotated by a force generated from a magnetic field generated between the stator 121 and the rotor 122. The rotational force of the rotor 122 may be transmitted to the compression unit 130 via the rotation shaft 123 passing through a center of the rotor 122.

A suction port 133*a* is disposed within one side of the middle shell 110*b*. The discharge tube 114 is disposed within one side of the upper shell 110*a*. Refrigerant is supplied into the casing 110 through the suction port 133*a*. Compressed refrigerant in the casing 110 is discharged through the discharge tube 114.

The suction port 133*a* communicates refrigerant from an evaporator (not shown) forming a refrigeration cycle with the suction tube 113 and the casing 110. The discharge tube 114 is connected to a condenser (not shown) forming the refrigeration cycle.

The compression unit 130 disposed inside the casing 110 compresses the refrigerant suctioned thereto and then discharges the compressed refrigerant. The suction and discharge of the refrigerant takes place inside the cylinder 133 having the compression spaces V1 and V2 defined therein.

Figure 2:
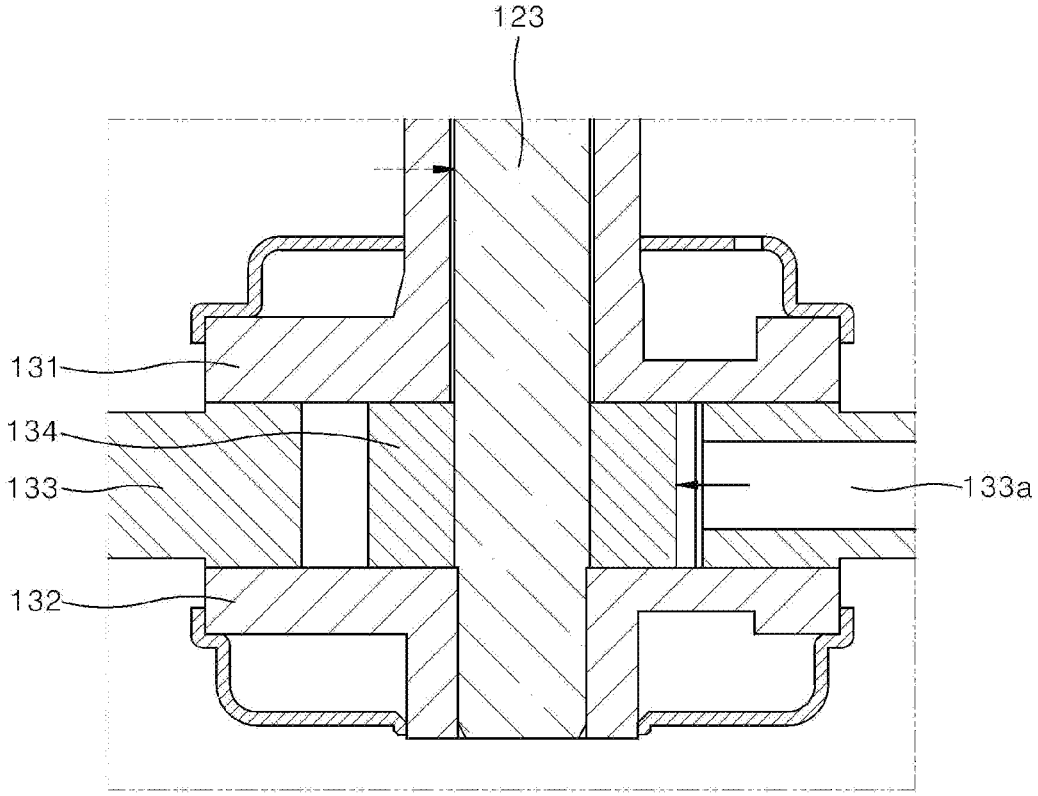
FIG. 2 is an enlarged view of an inside of the rotary compressor of FIG. 1.
Figure 3:
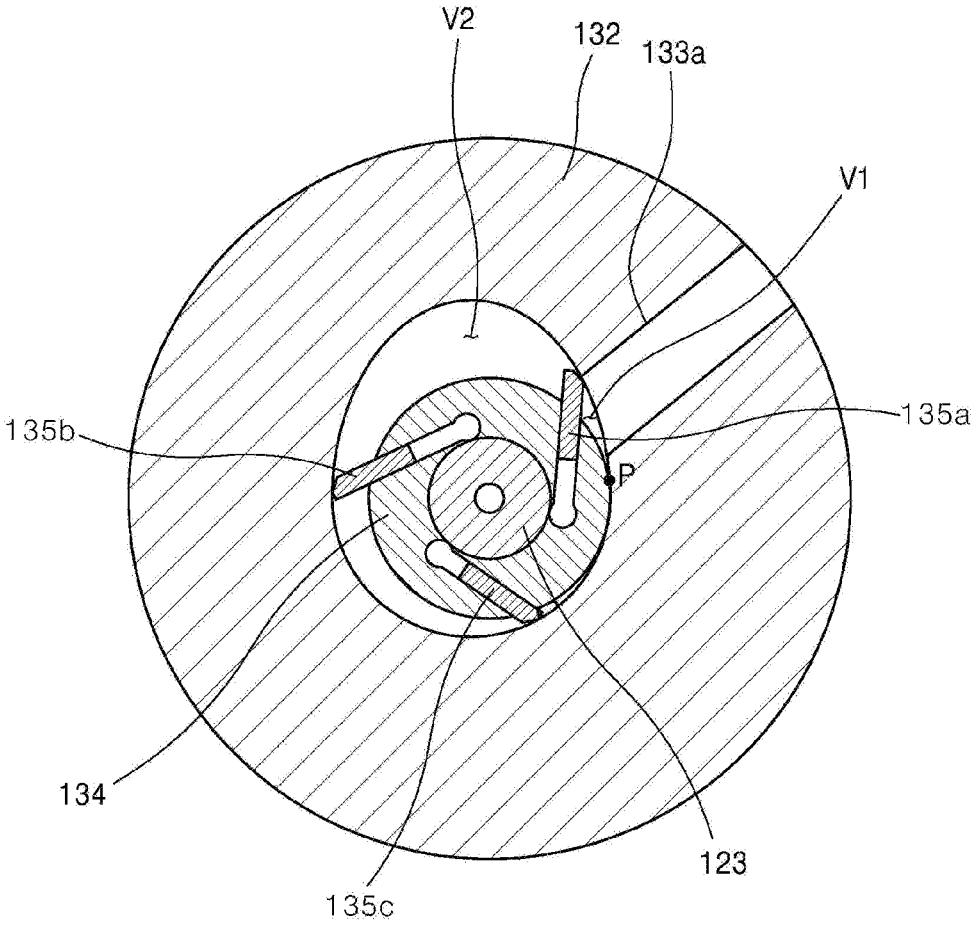
FIG. 3 is a plan view showing a structure of a compression unit of the rotary compressor of FIG. 1.

FIG. 2 is an enlarged view of an inside of the rotary compressor 100 of FIG. 1. FIG. 3 is a plan view of the compression unit 130.

Inside the cylinder 133, the roller 134 is disposed. The roller 134 rotates about the rotation shaft 123. The roller contacts the inner circumferential face of the cylinder 133 to define the compression spaces V1 and V2.

The roller 134 rotates integrally with the rotation shaft 123. At this time, while one contact point P is formed between the roller 134 and the inner circumferential face of the cylinder 133, the roller rotates.

The roller is disposed inside the cylinder 133 so that one side of the roller 134 contacts the inner circumferential face of the cylinder 133. The roller 134 rotates with the rotation shaft 123 to define the compression spaces V1 and V2 in the cylinder 133.

The roller 134 has a plurality of vane slots defined therein. A plurality of vanes 135 may be inserted into the slots or drawn out of the slots respectively. Each vane 135 moves linearly within each vane slot. Each vane 135 maintains a state of contact with the inner circumferential face of the cylinder 133 and reciprocates linearly.

Each vane 135 is drawn out into the compression spaces V1 and V2 and abuts against the inner circumferential face of the cylinder 133. As a result, the compression spaces V1 and V2 inside the cylinder 133 may be divided via the vane into a suction chamber V1 and a compression chamber V2, respectively.

As the rotation shaft 123 rotates, each vane 135 rotates together with the roller 134. At this time, each vane 135 moves while contacting the inner circumferential face of the cylinder 133. A space formed in the cylinder 133 may be partitioned by the roller 134 and the vane 135 to define the compression spaces.

The refrigerant flowing from the suction port 133*a* is compressed by the movement of the vane 135. The compressed refrigerant then moves along the discharge port and then discharged through a discharge hole formed in the main bearing 131 or the auxiliary bearing 132.

However, since the contact point P between the cylinder 133 and the roller 134 is maintained at the same position, and a front end of the vane 135 moves along the inner circumferential face of the cylinder 133, the pressure generated in the compression spaces V1 and V2 is continuously increased as the vane 135 moves.

A solid line arrow in the figure shows a position of an axial maximum gas force during operation of the rotary compressor 100. As shown, the axial maximum gas force occurs at a position close to the discharge port. This position is always constant.

Further, the number of times that the axial maximum gas force is generated corresponds to the number of vanes per revolution of the roller. In the illustrated embodiment, three vanes are provided. Therefore, the axial maximum gas force is generated three times per revolution of the roller.

In the figure, a dotted arrow indicates a maximum reaction force generated on a journal of the rotation shaft when the axial maximum gas force is generated. Since the generation position of the axial maximum gas force is not changed, the maximum reaction force generated on the journal also occurs at a constant position. Such a configuration causes a mechanical loss of the journal, resulting in a decrease in durability of the compressor product.

The present disclosure is designed to remedy the above problem. According to the present disclosure, two compression units are arranged along one rotation shaft such that the axial maximum gas forces that occur from the two compression units may counteract each other. This provides a configuration that may reduce the mechanical loss of the journal. In other words, the axial maximum gas forces from the two compression units act in opposite directions. As a result, a net reaction force acting on the journal of the rotation shaft may be reduced. When the net reaction force acting on the journal of the rotation shaft is reduced, a frictional force against the journal decreases, thereby reducing the mechanical loss occurring in the journal.

Next, a reference will be made to a change in operation characteristics of the rotary compressor based on the number of vanes.

Figure 4:
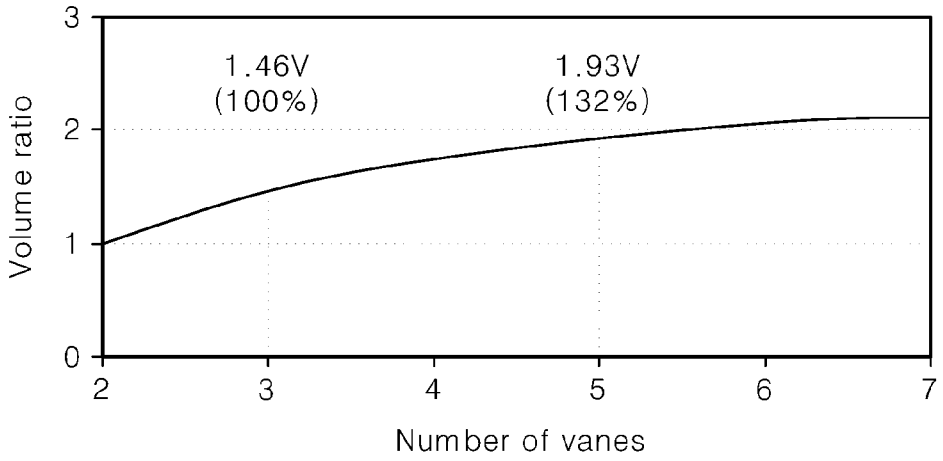
FIG. 4 shows a volume diagram based on the number of vanes.

FIG. 4 shows a volume diagram based on the number of vanes.

As shown, as the number of vanes increases, the volume ratio (compression ratio) increases. As the number of the vanes increases, the friction area increases correspondingly, and, thus, mechanical loss due to friction increases.

Table 1 shows a suction period, a compression period, and a stroke volume when the number of vanes is three, and when the number of vanes is five.

TABLE 1

| Number of vanes | Suction period | Compression period | Sum of suction and compression periods | Stroke volume |
|---|---|---|---|---|
| 3 | 184° | 296° | 480° | 100% |
| 5 | 145° | 287° | 432° | 118% |

As shown in Table 1, as the number of vanes increases, the suction and compression periods decrease and the stroke volume increases. When the number of vanes is 3, the stroke volume is 100% as a reference value. Increasing the number of vanes from three to five increases the stroke volume from 100% to 118%. When the stroke volume is increased, the compression ratio may be increased.

On the other hand, increasing the number of vanes from 3 to 5 reduces the suction period from 184° to 145°.

As a result, there is a relationship in which the increase of the stroke volume and the increase of the compression period may not be simultaneously achieved.

Figure 5:
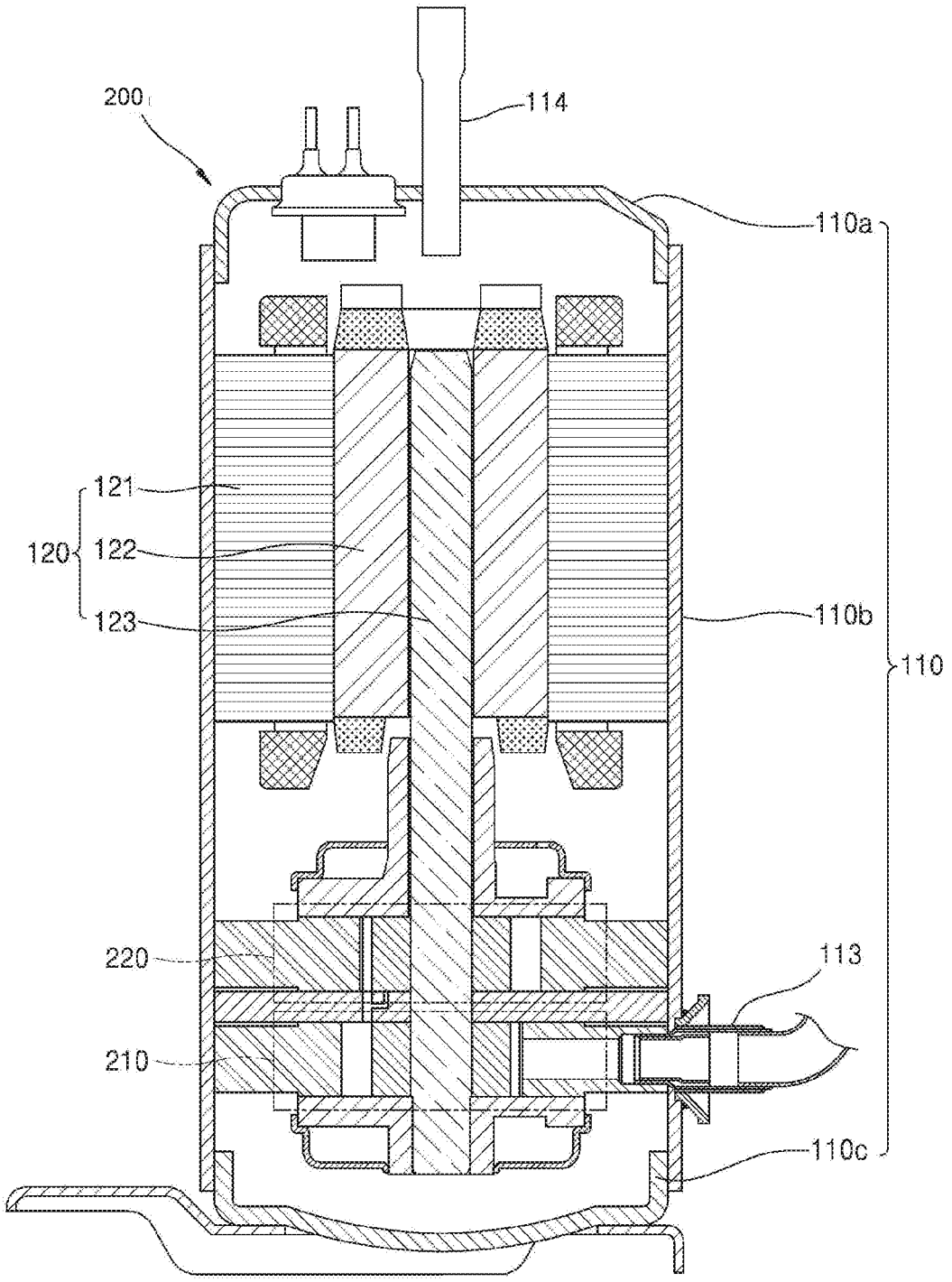
FIG. 5 shows a two-stage rotary compressor according to an embodiment of the present disclosure.

FIG. 5 shows a two-stage rotary compressor according to an embodiment of the present disclosure.

The rotary compressor 200 according to an embodiment of the present disclosure includes a casing 110, driving means 120, a rotation shaft 123, a first compression unit 210, and a second compression unit 220. The first compression unit 210 and the second compression unit 220 are configured to operate via a single rotation shaft 123.

The casing 110 and the driving means 120 are the same as those of the conventional compressor as described above. Therefore, redundant description of these components will be omitted.

The first compression unit 210 of the rotary compressor 200 according to the present embodiment suctions refrigerant flowing from an upstream side of the refrigeration cycle. The second compression unit 220 suctions refrigerant (hereinafter, referred to as middle pressure refrigerant) which has been compressed in the first compression unit 210 and discharged to the second compression unit 220. The first compression unit 210 and the second compression unit 220 compress the suctioned refrigerant thereto. The refrigerant compressed in the first compression unit 210 is called a middle pressure refrigerant, while the refrigerant compressed in the second compression unit 220 is called a high pressure refrigerant.

As described above, as the number of vanes placed in the compression chamber changes, the stroke volume and suction compression periods change. As a result, an increase in the stroke volume and an increase in the compression period may not be simultaneously achieved.

In the rotary compressor according to the present disclosure, the middle pressure refrigerant discharged from the first compression unit 210 flows into the second compression unit 220. The high pressure refrigerant discharged from the second compression unit 220 is supplied to a refrigeration cycle system.

Accordingly, the first compression unit 210 has the number of vanes set to secure the stroke volume. The second compression unit 220 has the number of vanes set to secure the compression period. Thus, the stroke volume and the compression period required in the rotary compressor may be secured.

Further, in the rotary compressor 200 according to the present disclosure, the first compression unit 210 and the second compression unit 220 are connected to the same rotation shaft. The first compression unit 210 and the second compression unit 220 are arranged such that the axial maximum gas force generated from the first compression unit 210 and the axial maximum gas force generated from the second compression unit 220 counteract each other. Thus, the net reaction force applied to the journal supporting the rotation shaft may be reduced.

Figure 6:
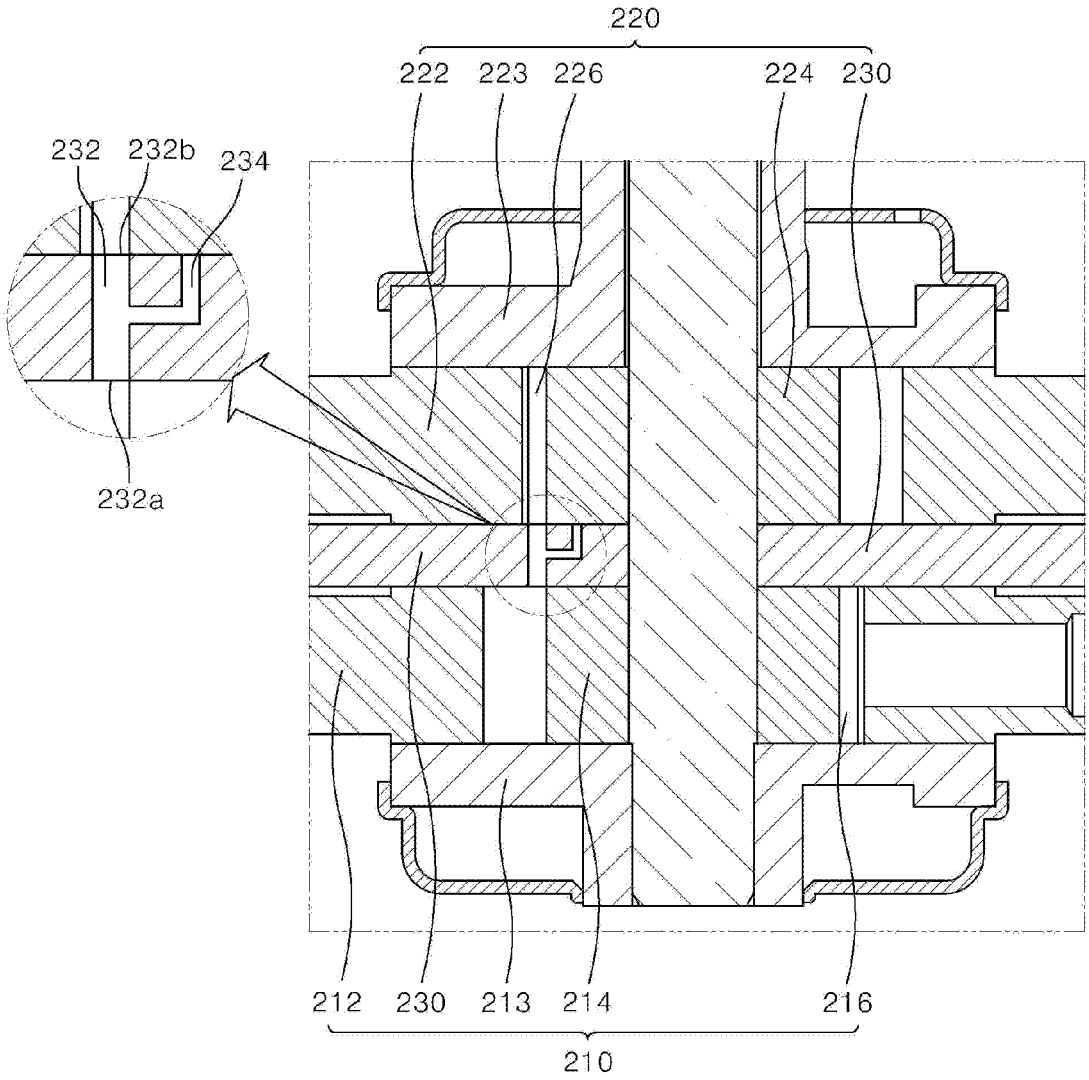
FIG. 6 shows a planar structure of a rotary compressor according to an embodiment of the present disclosure.

FIG. 6 is a cross-sectional view of the first compression unit and the second compression unit of the rotary compressor according to an embodiment of the present disclosure.

As shown, the first compression unit 210 includes a first cylinder 212, a first roller 214, a plurality of vanes 216, an auxiliary bearing 213, and an intermediate spacer 230.

The first cylinder 212 has a refrigerant receiving space with an eccentric shape defined therein. A lower end of the refrigerant receiving space of the first cylinder 212 is sealed with the auxiliary bearing 213, while an upper end of the refrigerant receiving space is sealed with the intermediate spacer 230.

The first roller 214 is disposed in the refrigerant receiving space and rotates integrally with the rotation shaft. The first roller 214 has a plurality of vane slots 215 defined therein.

The vane 216 is received in a vane slot 215 in the first roller 214. The vane 216 is drawn out toward and contacts the inner circumferential face of the cylinder via a centrifugal force generated when the first roller 214 rotates and a back pressure applied to the vane slot 215.

The first cylinder 212 is provided with a suction hole 212*a* through which low-pressure refrigerant flowing from an upstream side of the refrigeration cycle is suctioned into the compression chamber.

The middle pressure refrigerant, which has been compressed in the first compression unit 210 and discharged to the outside thereof, flows into the second compression unit 220, which will be described later. To this end, the intermediate spacer 230 has a middle pressure refrigerant channel 232 defined therein.

An inlet 232*a* of the middle pressure refrigerant channel 232 formed in a bottom of the intermediate spacer 230 serves as a refrigerant discharge hole for the first compression unit 210. An outlet 232*b* of the middle pressure refrigerant channel 232 formed in a top of the intermediate spacer 230 serves as a refrigerant suction hole for the second compression unit 220.

The second compression unit 220 includes a second cylinder 222, a second roller 224, a plurality of vanes 226, a main bearing 223, and the intermediate spacer 230.

The second cylinder 222 has a refrigerant receiving space with an eccentric shape defined therein. A lower end of the refrigerant receiving space of the second cylinder 222 is sealed with the intermediate spacer 230, while an upper end of the refrigerant receiving space is sealed with the main bearing 223.

The second roller 224 is disposed in the refrigerant receiving space and rotates integrally with the rotation shaft. The second roller 224 has a plurality of vane slots 225 defined therein.

The vane 226 is received in the vane slot 225 in the second roller 224. The vane 226 is drawn out toward and contacts the inner circumferential face of the cylinder via a centrifugal force generated when the second roller 224 rotates and a back pressure applied to the vane slot 225.

The middle pressure refrigerant may act to apply a back pressure to the vane slot 225 in the second roller 224. To this end, a back-pressure refrigerant channel 234 may be defined in the intermediate spacer 230. The back-pressure refrigerant channel 234 communicates the discharge hole of the first compression unit 210 and the vane slot 225 of the second roller 224 with each other.

In this regard, the back-pressure refrigerant channel 234 may be configured to share a partial path with the middle pressure refrigerant channel 232 and to branch from the middle pressure refrigerant channel 232. Alternatively, the back-pressure refrigerant channel 234 may have an independent path from the middle pressure refrigerant channel 232.

Further, the rotary compressor according to an embodiment of the present disclosure may be configured such that a maximum gas reaction force of the first compression unit 210 and a maximum gas reaction force of the second compression unit 220 counteract with each other.

The axial maximum gas force of the first compression unit 210 and the axial maximum gas force of the second compression unit 220 act in directions opposite to each other with the rotation shaft being disposed therebetween, thereby reducing the net reaction force applied to the journal. When the axial maximum gas force of the first compression unit 210 and the axial maximum gas force of the second compression unit 220 have a phase difference of 180°, the counteract effect may be maximized.

To this end, a suction hole of the first compression unit 210 and a suction hole of the second compression unit 220 may have a phase difference of about 150 to 210 degrees. This is because a position of the suction hole is ultimately related to an occurrence position of the axial maximum gas force.

In one embodiment, for increasing the stroke volume, the first compression unit 210 preferably has a relatively larger number of vanes as compared to the second compression unit 220. For increasing the compression period, the second compression unit 220 preferably has a relatively smaller number of vanes as compared to the first compression unit 210.

In other words, when the number of vanes of the second compression unit 220 is N+1 (N is a natural number), the number of vanes of the first compression unit 210 is preferably N+2.

The rotary compressor according to an embodiment of the present disclosure may be configured such that the rotation shaft and one of the first roller or the second roller are integrally machined while the other roller is joined to the rotation shaft.

In this connection, the intermediate spacer 230 may be divided into a plurality of pieces. The divided pieces may be assembled between the first roller and the second roller. Such a configuration may improve the assembling of the first compression unit and the second compression unit.

Figure 7:
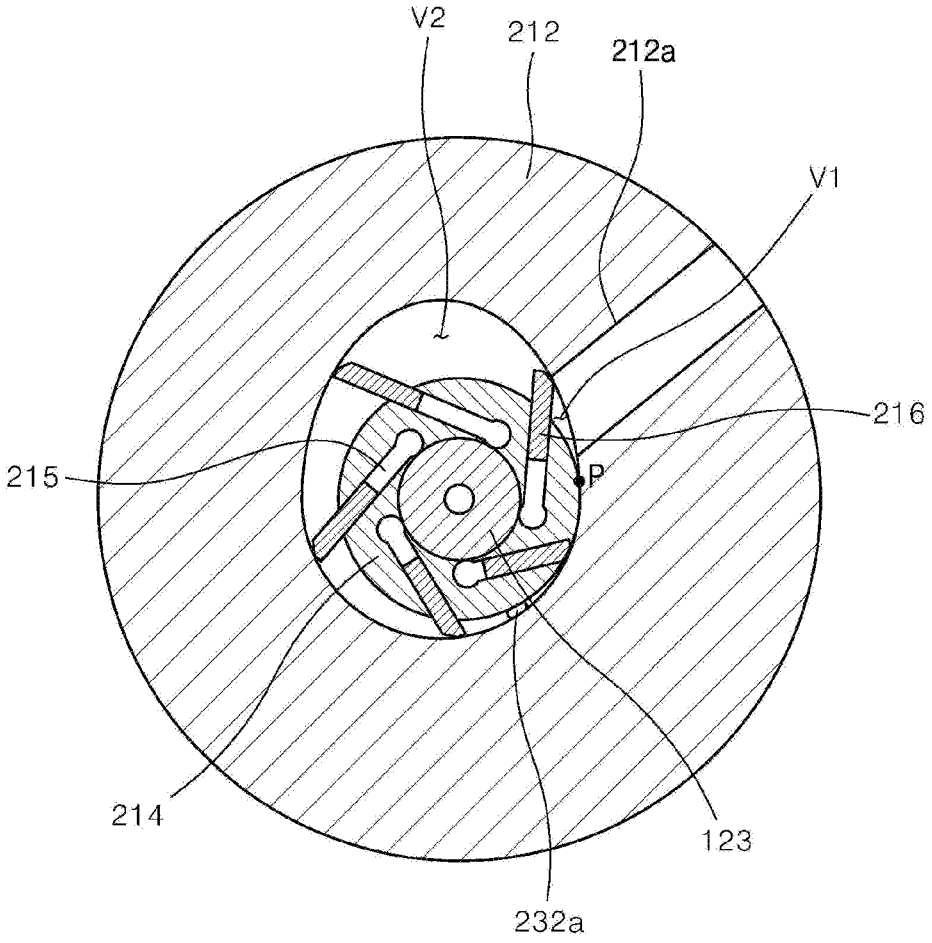
FIG. 7 is a planar structure of a first compression unit of a rotary compressor according to an embodiment of the present disclosure.
Figure 8:
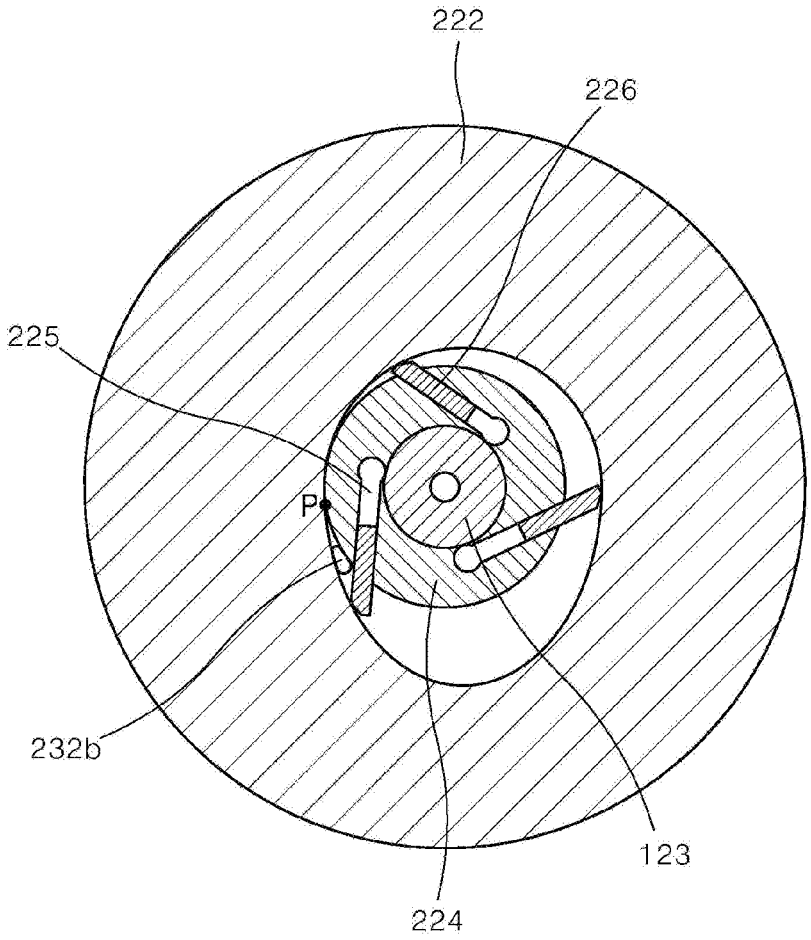
FIG. 8 is a planar structure of a second compression unit of a rotary compressor according to an embodiment of the present disclosure.

FIG. 7 is a plan view of the first compression unit of a rotary compressor according to an embodiment of the present disclosure. FIG. 8 is a plan view of the second compression unit of a rotary compressor according to an embodiment of the present disclosure.

Referring to FIG. 7, the first compression unit 210 of the rotary compressor according to an embodiment of the present disclosure functions to suction a low-pressure refrigerant therein, to pressurize the refrigerant to a middle pressure, and to discharge the middle pressure refrigerant.

In order to increase the stroke volume, the first compression unit 210 preferably has a relatively large number of vanes. In the illustrated embodiment, the first compression unit 210 has five vanes 216. As shown in Table 1 above, when the number of vanes is 5, the stroke volume is 118%, which is advantageous for securing a suction flow rate.

The refrigerant compressed in the first compression unit 210 is discharged to the middle pressure refrigerant channel inlet and then supplied to the second compression unit 220.

Referring to FIG. 8, the second compression unit 220 of the rotary compressor according to the present disclosure embodiment function to suck the middle pressure refrigerant therein, to pressurize the refrigerant to high pressure and then to discharge the high pressure refrigerant.

To increase the compression period, the second compression unit 220 preferably has a relatively small number of vanes. In the illustrated embodiment, the second compression unit 220 has three vanes 226. As shown in Table 1 above, when the number of vanes is 3, the compression period is 296°, which has an effect of reducing a indicated loss.

Figure 9:
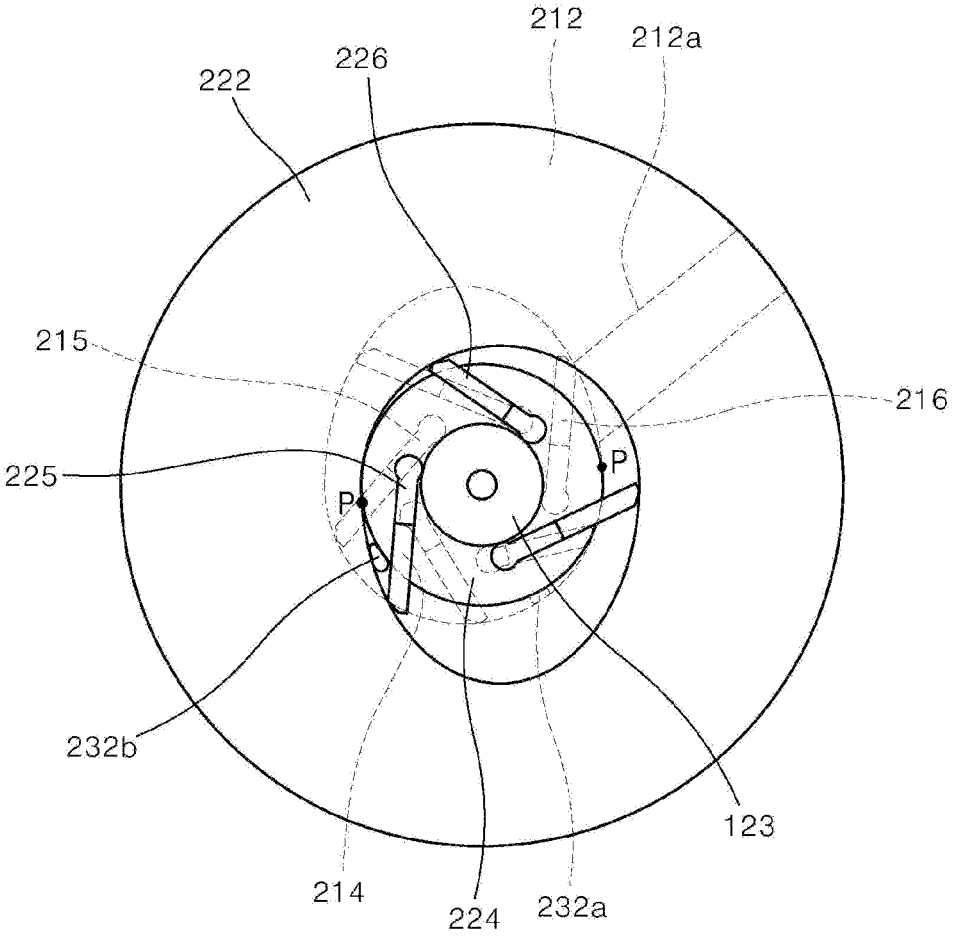
FIG. 9 is a diagram showing, in an overlapped manner, a planar structure of a first compression unit and a second compression unit of a rotary compressor according to an embodiment of the present disclosure.

FIG. 9 is a diagram showing, in an overlapped manner, a planar structure of a first compression unit and a second compression unit of a rotary compressor according to an embodiment of the present disclosure.

In order to clarify the distinction between the first compression unit 210 and the second compression unit 220 in the figure, the first compression unit 210 is indicated by a dotted line and the second compression unit 220 is indicated by a solid line.

Referring to FIG. 9, it may be seen that respective contact points Ps between the first cylinder 212 and the second cylinder 222 and the first and second rollers 214 and 224 are positioned opposite to each other with the rotation shaft being disposed therebetween.

The first roller 214 of the first compression unit and the second roller 224 of the second compression unit have the same concentric axis. To this end, a shape of the refrigerant receiving space of the first cylinder 212 and a shape of the refrigerant receiving space of the second cylinder 222 should be configured to have a phase difference of about 180° (for example, 150° to 210°).

Thus, the axial maximum gas force of the first compression unit 210 and the axial maximum gas force of the second compression unit 220 act in opposite directions with each other with the rotation shaft being disposed therebetween. Thus, the load applied to the journal supporting the rotation shaft may be reduced.

The maximum gas reaction force of the first compression unit occurs from left to right on the drawing, while the maximum gas reaction force of the second compression unit occurs from right to left on the drawing. Thus, since the maximum gas reaction force of the first compression unit and the maximum gas reaction force of the second compression unit counteract each other, a net reaction force applied to the journal supporting the rotation shaft is reduced.

As mentioned above, the rotary compressor according to the present disclosure has a two-stage compression unit configuration. That is, the first compression unit compresses the low pressure refrigerant to the middle pressure, and, the second compression unit compresses the middle pressure refrigerant to the high pressure.

Further, in order to secure the stroke volume, the first compression unit has a relatively large number of vanes. In order to reduce the indicated loss, the second compression unit has a relatively small number of vanes.

Thus, the single rotary compressor may be configured to separately achieve the stroke volume increase and the compression period increase.

The detailed advantageous effects according to the present disclosure as well as the aforementioned effect have described above with regard to the embodiments of the present disclosure. The present disclosure described above may be variously substituted, altered, and modified by those skilled in the art to which the present disclosure pertains without departing from the scope and sprit of the present disclosure. Therefore, the present disclosure is not limited to the above-mentioned exemplary embodiments and the accompanying drawings.

What is claimed is:

1. A rotary compressor, comprising:

a motor;

a rotation shaft coupled to the motor;

a first compression unit, comprising:

a first cylinder attached to the rotation shaft, the first cylinder including a first refrigerant receiving space defined therein;

a first roller rotatingly disposed in the first refrigerant receiving space to rotate integrally with the rotation shaft; and a first plurality of vanes inserted into the first roller in a retractable or extendable manner, wherein rotation of the first roller allows the first vanes to extend out of the first roller to contact an inner circumferential face of the first cylinder to divide a first compression space into a first suction chamber and a first compression chamber; and a second compression unit, comprising:

a second cylinder attached to the rotation shaft, the second cylinder has a second refrigerant receiving space defined therein;

a second roller rotatingly disposed in the second refrigerant receiving space to rotate integrally with the rotation shaft; and a second plurality of vanes inserted into the second roller in a retractable or extendable manner, wherein rotation of the second roller allows the second vanes to extend out of the roller to contact an inner circumferential face of the second cylinder to divide a second compression space into a second suction chamber and a second compression chamber, wherein refrigerant compressed in and discharged out of the first compression unit applies a back pressure to the second vanes of the second compression unit to extend out of the second roller of the second compression unit.

2. The compressor of claim 1, wherein a suction position of the first compression unit and a suction position of the second compression unit have a phase difference of 150 to 210 degrees.

3. The compressor of claim 1, wherein a number of the first vanes is larger than a number of the second vanes.

4. The compressor of claim 1, wherein either the first roller or the second roller is integrally formed with the rotation shaft.

5. A rotary compressor comprising:

a motor;

a rotation shaft coupled to the motor;

a first compression unit comprising:

a first cylinder attached to the rotation shaft, the first cylinder including a first refrigerant receiving space defined therein;

a first roller rotatingly disposed in the first refrigerant receiving space to rotate integrally with the rotation shaft; and a plurality of first vanes inserted into the first roller in a retractable or extendable manner, wherein rotation of the first roller allows the first vanes to extend out of the first roller to contact an inner circumferential face of the first cylinder to divide a first compression space into a first suction chamber and a first compression chamber, wherein a number of the first vanes is N+2 and a second compression unit comprising:

a second cylinder attached to the rotation shaft, the second cylinder including a second refrigerant receiving space defined therein;

a second roller rotatingly disposed in the second refrigerant receiving space to rotate integrally with the rotation shaft; and a plurality of second vanes inserted into the second roller in a retractable or extendable manner, wherein rotation of the second roller allows the second vanes to extend out of the second roller to contact an inner circumferential face of the second cylinder to divide a second compression space into a second suction chamber and a second compression chamber, wherein a number of the second vanes is N+1, wherein N in the N+1 and N+2 is a same natural number, and wherein refrigerant compressed in and discharged out of the first compression unit applies a back pressure to the second vanes of the second compression unit to extend out of the second roller of the second compression unit.

6. The compressor of claim 5, comprising an intermediate spacer separating the first compression unit from the second compression unit, the intermediate spacer including a middle-pressure refrigerant channel defined therein for communicatively coupling refrigerant compressed in and discharged out of the first compression unit with a suction port of the second compression unit.

7. The compressor of claim 6, wherein the intermediate spacer further includes a back-pressure refrigerant channel defined therein for communicatively coupling the refrigerant compressed in and discharged out of the first compression unit with slots defined in the second compression unit.

8. The compressor of claim 7, wherein one end of the back-pressure refrigerant channel is fluidly connected to the middle-pressure refrigerant channel.

9. The compressor of claim 7, wherein the second vanes are slidably disposed in the slots defined in the second compression unit.

10. The compressor of claim 5, wherein either the first roller or the second roller is integrally machined with the rotation shaft.

11. The compressor of claim 5, further including:

a main bearing; and an auxiliary bearing, the first cylinder and the second cylinder being disposed between the main bearing and the auxiliary bearing.

12. The compressor of claim 5, further including an intermediate spacer disposed between the first cylinder and the second cylinder.

* * * * *